US006643884B1

(12) United States Patent
Everett

(10) Patent No.: US 6,643,884 B1
(45) Date of Patent: Nov. 11, 2003

(54) BABY TOOTHBRUSH

(76) Inventor: Wendy A. Everett, 1123 Sasco Hill Rd., Fairfield, CT (US) 06430

( * ) Notice: Subject to any disclaimer, the term of this patent is extended or adjusted under 35 U.S.C. 154(b) by 128 days.

(21) Appl. No.: 09/908,786

(22) Filed: Jul. 18, 2001

(51) Int. Cl.[7] ..... A46B 5/02; A46B 9/04; A61J 17/00

(52) U.S. Cl. ..... 15/110; 15/143.1; 15/167.1; 606/235

(58) Field of Search ..... 15/105, 110, 143.1, 15/167.1; 132/308, 311; 446/71, 227, 419; 601/139, 141; 606/234, 235; D4/104, 108, 111, 112

(56) References Cited

U.S. PATENT DOCUMENTS 1,054,709 A * 3/1913 Munro ..... 15/143.1
1,364,188 A * 1/1921 Draenert ..... 132/311 X
2,317,123 A * 4/1943 Warp ..... 15/167.1 X
2,532,116 A * 11/1950 Monaco ..... 446/419
2,703,087 A * 3/1955 Newmark ..... 606/235
3,010,131 A * 11/1961 Kisky ..... 15/167.1
4,150,457 A * 4/1979 Larson ..... 15/167.1 X
5,291,878 A * 3/1994 Lombardo et al. ..... 601/139
5,398,369 A * 3/1995 Heinzelman et al. ..... 15/167.1
5,729,859 A * 3/1998 Guffin, III ..... 15/167.1
5,966,769 A * 10/1999 Tortorice ..... 15/105
6,134,737 A * 10/2000 Remme ..... 15/110

FOREIGN PATENT DOCUMENTS

DE 909688 * 4/1954 ..... 15/105

* cited by examiner

*Primary Examiner*—Mark Spisich
(74) *Attorney, Agent, or Firm*—Joseph N. Breaux

(57) ABSTRACT

A baby toothbrush that includes a piece of plastic molded to fit a baby's hand, with a circular brush head protruding from its base. The piece of plastic has an internal cavity formed therein that in one embodiment is filled with rattle beads and in another embodiment filled with a fluid and floating items.

3 Claims, 3 Drawing Sheets

BABY TOOTHBRUSH

TECHNICAL FIELD

The present invention is that of a toothbrush for baby to use safely, and effectively with minimal parental aid. The present invention would comprise a piece of plastic molded to fit a baby's hand, with a circular brush head protruding from its base.

BACKGROUND ART

It is desirable to teach children good oral hygiene habits as soon as possible. Although it is desirable to teach children good oral hygiene, the elongated toothbrush handle can pose a choking hazard to a small child. It would be desirable, therefore, to have a baby toothbrush that had a molded handgrip piece shaped to fit into the palm of a baby's hand in place of an elongated handle.

GENERAL SUMMARY DISCUSSION OF INVENTION

It is thus an object of the invention to provide a baby toothbrush that includes a piece of plastic molded to fit a baby's hand, with a circular brush head protruding from its base. Accordingly, a baby tooth brush is provided. The baby tooth brush includes a piece of plastic molded to fit a baby's hand, with a circular brush head protruding from its base.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
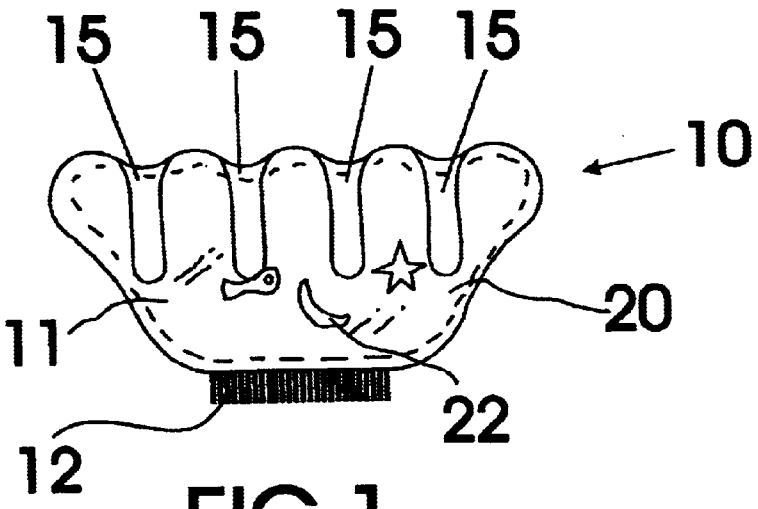
FIG. 1 is a side view of an exemplary embodiment of the baby toothbrush of the present invention

The present invention 10 is a piece 11 of plastic molded to fit a baby's hand, and would include finger and thumb grips 15. The design of the present invention would be ambidextrous, so that a baby cold pick up the present invention easily with either hand. The bristles 12 located on the present invention would be short, soft, and round tipped for protection of a baby's gentle skin and gums. The bristles 12 would be set into the piece 11 of plastic at its base 13 in a circular pattern so that the baby could bring the present invention into its mouth at any angle and still achieve full coverage of its teeth.

Figure 2:
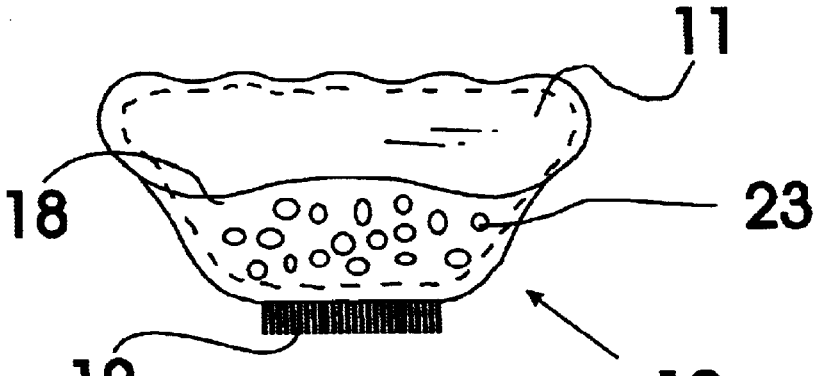
FIG. 2 is a second side view of the baby toothbrush of FIG. 1.
Figure 3:
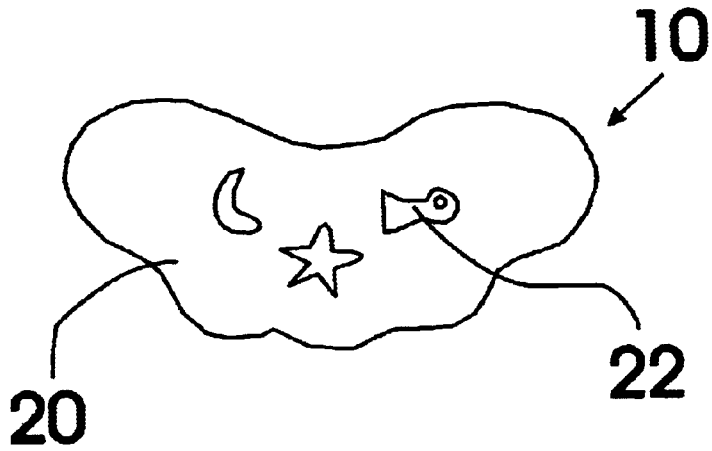
FIG. 3 is a top plan view of the baby toothbrush of FIG. 1.
Figure 4:
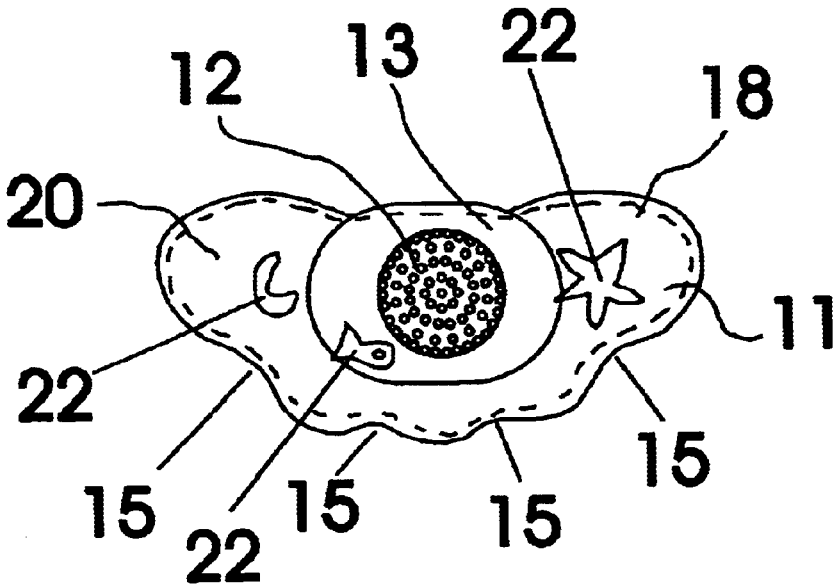
FIG. 4 is a bottom plan view of the baby toothbrush of FIG. 1.
Figure 5:
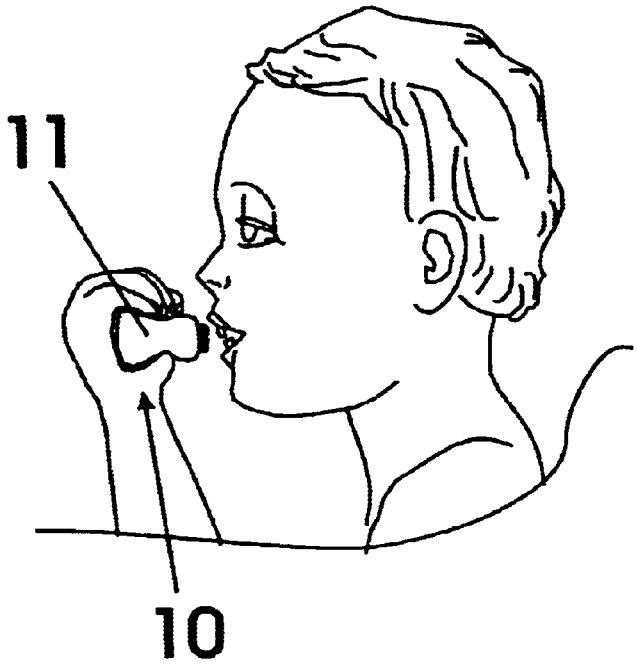
FIG. 5 is a view of the baby toothbrush of FIG. 1 in use.
Figure 6:
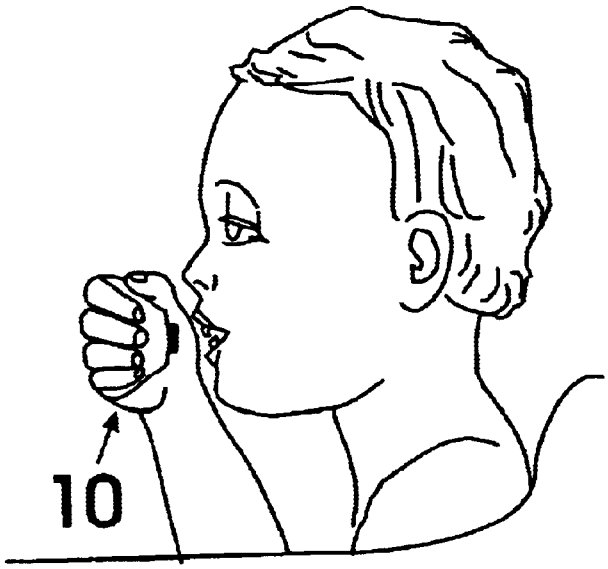
FIG. 6 is a second view of the baby toothbrush of FIG. 1 in use.

The present invention can be seen in a finger side view on FIG. 1 The present invention.can be seen in a palm side view in FIG. 2 The present invention can be seen in a top view in FIG. 3. The present invention can be seen in a bottom view in FIG. 4. The present invention can be seen in use in FIGS. 5 and 6.

With the present invention, a baby is in control and brushing teeth becomes a happy experience. It promotes not only a lifetime of good oral hygiene, but also a sense of independence and makes a baby feel good about himself. The present invention is large enough to eliminate any possibility of a choking hazard.

The present invention would be fabricated from a semi-soft plastic, which would be the kind a baby's hand could grip easily without slipping when wet and would be available in an assortment of colors and designs appealing and interesting to a baby. The bristles on the present invention would be the softest kind available.

The present invention could be made with many different alternative features. Alternative features that the present invention could posses would be designed to rattle, play music, or light up when shaken or squeezed. In the embodiment shown in FIGS. 1, and 3–6, the present invention 10 has a cavity 18 formed within a transparent plastic that is filled with a fluid 20 and a variety of items 22 that float in this fluid to stimulate a baby's brain. The present invention may be placed in the freezer to chill the fluid 20 and the piece 11 used as a teething ring and used to sooth teething pain.

In an alternative embodiment shown in FIG. 2, the cavity 18 is filled with beads 23 that make a ratting noise instead of the fluid 20 and the float items 22.

In use, the present invention is designed to be a babies first toothbrush. It can be used to brush each frontal tooth as each one appears. Since the handle is virtually eliminated, all danger of sticking the.brush down a baby's throat is eliminated, therefore making this brush perfectly safe for babies and toddlers. Parents can encourage independent use of this toothbrush, allowing the baby an increased sense of self confidence.

It can be seen from the preceding description that a baby toothbrush has been provided.

It is noted that the embodiment of the baby toothbrush described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A baby toothbrush comprising:

a body of molded transparent plastic having first and second ends, said body having a plurality of molded finger and thumb grips formed about the periphery thereof; and a brush comprising a plurality of bristles arranged in a circular pattern and extending from a base of the plastic body in a generally central region of said body between said ends.

2. The baby toothbrush of claim 1 further comprising:

a sealed internal cavity within the molded transparent plastic body;

a quantity of fluid filling the sealed internal cavity; and a number of floating items floating in the quantity of fluid filling the sealed internal cavity.

3. The baby toothbrush of claim 1 further comprising:

a sealed internal cavity within the molded transparent plastic body; and a quantity noise making beads partially filling the sealed internal cavity in a manner such that shaking the molded transparent plastic body causes the noise making beads to generate sound.

* * * * *